United States Patent [19]

Johnson

[11] Patent Number: 4,484,404

[45] Date of Patent: Nov. 27, 1984

[54] SPARE MAGAZINE HOLDER

[75] Inventor: David A. Johnson, Klamath Falls, Oreg.

[73] Assignee: J.F.S., Inc., Salem, Oreg.

[21] Appl. No.: 417,409

[22] Filed: Sep. 13, 1982

[51] Int. Cl.[3] ..... F41C 27/00; F41C 25/00

[52] U.S. Cl. ..... 42/90; 42/18

[58] Field of Search ..... 42/90, 18, 50

[56] References Cited

U.S. PATENT DOCUMENTS

| | | | |
|---|---|---|---|
| 2,130,383 | 9/1938 | End | 42/18 |
| 4,100,694 | 7/1978 | Musgrave | 42/90 |
| 4,115,943 | 9/1978 | Musgrave | 42/90 |

*Primary Examiner*—Charles T. Jordan

*Attorney, Agent, or Firm*—Chernoff, Vilhauer, McClung, Birdwell & Stenzel

[57] ABSTRACT

A protective carrier for holding a loaded spare magazine in a position of readiness for immediate insertion into operative engagement with a firearm. A latch release mechanism is operable simultaneously with the operation of the magazine release mechanism of the firearm, permitting an empty magazine and a loaded spare magazine to be released together, the empty magazine being allowed to fall clear of the firearm while the loaded spare magazine is grasped and inserted into the weapon for use in a minimum amount of time. The spare magazine carrier of the invention protectively surrounds the open upper end of the spare magazine to shield cartridges held therein against contamination by dirt, mud, and the elements, in order to help avoid malfunction or damage of the weapon.

15 Claims, 7 Drawing Figures

SPARE MAGAZINE HOLDER

BACKGROUND OF THE INVENTION

The present invention relates to repeating firearms, and particularly to an accessory for a repeating firearm using a replaceable magazine.

In land warfare the individual infantry soldier is still an important part of military operations. The effectiveness of the individual soldier depends to a large extent on the accuracy, rate of fire, and number of rounds of ammunition which each individual soldier is capable of providing. For that reason, modern infantry weapons are capable of high cyclic rates of fire and are usually equipped with magazines capable of holding dozens of cartridges. Such magazines must usually be manually released from the weapon when they have become empty, at which time a full magazine must be inserted into the weapon before firing may be continued. In order to be capable of sustained firing an infantry soldier carries loaded spare magazines, typically held in protective pouches attached to ammunition belts. When actually engaged in combat it is common for soldiers to carry spare magazines ready for more immediate use, since removal of a loaded magazine from a cartridge belt may take an undesirably long time.

It is clumsy, however, to carry a loaded spare magazine in one's hand, since it detracts from the ability to securely hold the weapon and accurately direct its fire.

In order to provide an ability to fire more rounds quickly, magazines have previously been welded together side by side, usually in opposing orientation which requires the welded pair to be turned over between releasing an empty magazine and inserting the loaded spare magazine of a pair into the weapon. This procedure takes an undesirably long amount of time, is awkward, and means that a spare welded pair of magazines is twice as heavy and clumsy to carry in the hand as a single one.

Soldiers have also been known to carry spare magazines into combat taped together in pairs for quick accessibility for reloading their weapons. This practice also reduces the amount of time to reload, compared with carrying spare magazines in a cartridge belt.

A problem common to use of paired magazines, carrying spare magazines in the hand, and carrying spare magazines taped together is that none of these techniques provides protection for the cartridges within such spare magazines. The magazines used with most automatic firearms retain the cartridges in such a way that they are not completely covered, but are able to be removed one by one by the operating mechanism of the firearm. The mechanism of the firearm, however, must be kept clean, and exposure of the open upper or outfeed end of a magazine to dust, dirt, mud, and weather is likely to result in malfunction of the weapon when such a magazine is inserted into the weapon for firing its cartridges. In a combat situation such a weapon failure could prove fatal.

While a longer period of sustained fire might be provided by simply using a larger magazine with the weapon, this solution is workable only so long as the increased size of the magazine does not interfere with convenient carrying or aiming of the weapon. Additionally, reliable cartridge feeding mechanisms for extremely large magazines may be somewhat complex and therefore undesirable.

In view of the previously known ways of providing quickly available loaded spare magazines, it appears that what is needed is a device for securely carrying a loaded spare magazine in a position where it is immediately available, held close to the location where it is to be inserted into a firearm for use. Such a device should protect ammunition in a spare magazine from contamination with dirt and moisture, and a spare magazine should be able to be removed from such a device and inserted into the weapon with only a minimum amount of manipulation.

SUMMARY OF THE INVENTION

The present invention meets the need for a way to hold a loaded spare magazine quickly available for use to replace an empty magazine of an automatic or semi-automatic military rifle by providing a box-like protective device which is attachable to a weapon such as an automatic rifle to hold a loaded spare magazine securely adjacent to the receiver. A latch mechanism is operable simultaneously with operation of the magazine release mechanism of the weapon, so that the loaded spare magazine is released from its protected position within the body of the device of the invention simultaneously with release of the empty magazine from the weapon.

The spare magazine carrier of the present invention comprises a box-like body portion including a top and sides which protectively surround the open upper or outfeed end of the loaded magazine. A latch included in the spare magazine carrier engages the magazine in the carrier in a manner similar to engagement of the magazine for use in the rifle itself.

A latch release mechanism is provided to engage a portion of the magazine release mechanism of the firearm so that operation of the magazine release mechanism also operates the latch release mechanism, in a preferred embodiment of the invention. Alternatively, operation of the latch release mechanism of the carrier of the invention may cause operation of the magazine release mechanism of the weapon, depending on the design of the weapon concerned. While it is possible to release a magazine from the spare magazine carrier of the invention without releasing a magazine from operative engagement in the weapon, it is also possible to substantially simultaneously release both the empty magazine from the weapon and the loaded spare magazine from the carrier to permit immediate insertion of the loaded spare magazine into the weapon for use.

It is therefore a primary objective of the present invention to provide a protective carrier for holding a spare magazine in a position ready for immediate use in a firearm.

It is another objective of the present invention to provide a carrier for a loaded spare magazine which provides protection against entry of dirt and rain into contact with the cartridges contained in the spare magazine, while holding the spare magazine ready for immediate use.

It is an important feature of the present invention that it includes a box adapted to protectively cover the open end of a loaded spare magazine for a firearm while holding the spare loaded magazine in a position closely adjacent to the position of a magazine operatively engaged in the firearm.

It is another important feature of the present invention that it provides a latch mechanism for releasing a loaded spare magazine for insertion into a weapon simultaneously with releasing an empty magazine from the weapon.

It is a principal advantage of the present invention that it permits quicker reloading of an automatic firearm than has been possible in the past.

It is another important advantage of the present invention that it provides a more convenient way to carry spare loaded magazines than has been available in the past.

It is yet a further advantage of the present invention that it provides better protection for an immediately available spare loaded magazine than has been available in the past.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
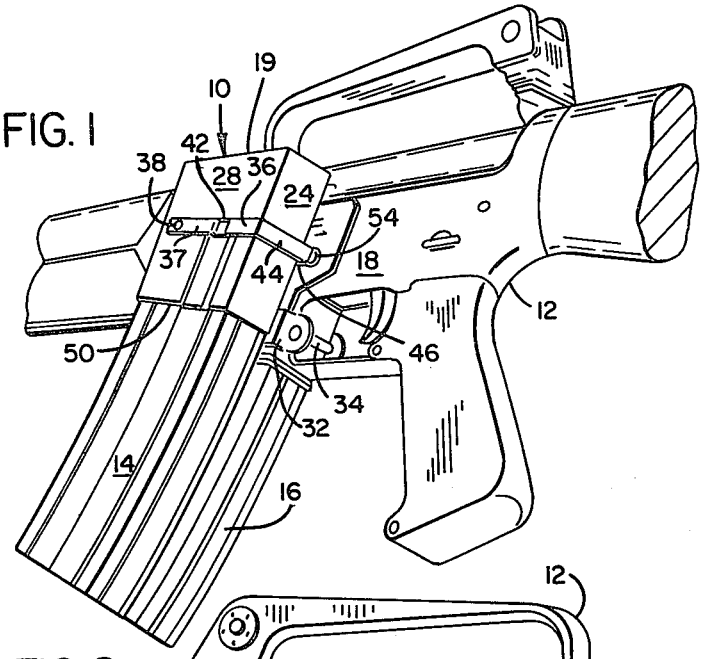
FIG. 1 is a perspective view of a protective carrier for a spare magazine, embodying the present invention, attached to an automatic rifle.
Figure 2:
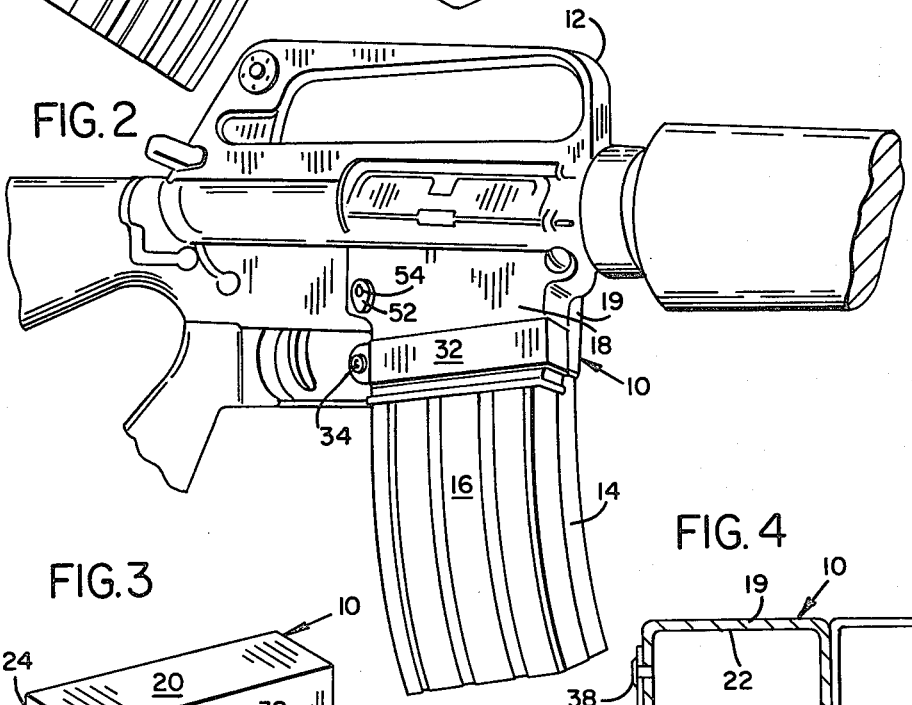
FIG. 2 is a perspective view of a portion of the right side of the automatic rifle and protective spare magazine carrier shown in FIG. 1.
Figure 3:
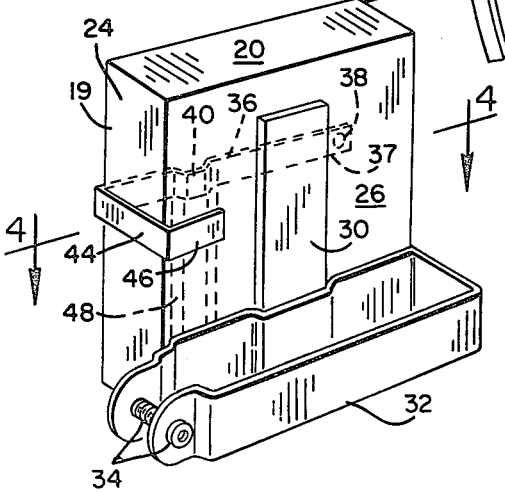
FIG. 3 is a perspective view of the spare magazine carrier shown in FIGS. 1 and 2, on an enlarged scale.

Referring now to the drawings, an exemplary spare magazine carrier 10 embodying the present invention is shown attached to an automatic rifle 12 in FIGS. 1 and 2. A spare magazine 14 is held in the carrier 10, while a magazine 16 is engaged in the receiver 18 of the automatic rifle 12, ready for use. The carrier 10 may be made, for example, of bent and welded sheet metal, and includes a body 19 having a top 20, a front side 22, a rear side 24, a right side 26, and a left side 28. A support brace 30 is fixedly attached to the right side 26, for example by welding, and an attachment strap 32 is fixedly connected with the support brace 30, for example also by welding. The attachment strap 32 extends around a portion of the receiver 18 and is held tightly by a fastener such as a bolt and nut combination 34.

A latch mechanism incorporated in the carrier 10 to releasably hold the spare magazine 14 includes a flat spring 36 having a forward end 37 fastened to the left side 28 by a fastener such a rivet 38. A catch 40, which may be an inwardly directed portion of the flat spring 36, extends through an opening 42 defined in the left side 28. The flat spring 36 extends further rearwardly along the left side 28 and is bent to define a transverse arm 44 and a forwardly extending tab 46. The transverse arm 44 is greater in length than the exterior width of the rear side 24, and the tab 46 is directed forward along the right side 26 as a stop to keep the catch 40 extending inwardly through the opening 42.

A portion of the left side 28 is offset outwardly, defining a channel 48 between the opening 42 and the open mouth 50 of the body 19, permitting a detent portion of a spare magazine 14 to pass upward within the carrier 10 to be engaged by the catch 40 to retain the spare magazine 14 with its open outfeed end within the carrier 10.

Figure 4:
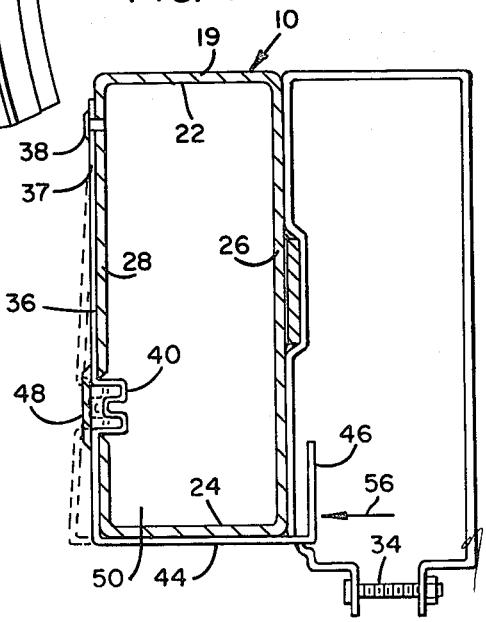
FIG. 4 is a sectional view of the spare magazine carrier shown in FIG. 3, taken along line 4—4, on an enlarged scale.

Referring once more to FIGS. 1 and 2 it will be seen that there is a push button 52 located on the right side of the receiver 18 of the rifle 12. Connected with the push button 52 is a push rod 54 which extends transversely through the receiver 18 to a laterally movable, forwardly extending magazine release (not shown) of the automatic rifle 12. The push rod 54 and push button 52 are normally biased to extend outwardly away from the right side of the receiver 18, but when the push button 52 is depressed (pushed leftward) to release the magazine 16 from the receiver 18, the left end of the push rod 52 also contacts the forwardly extending tab 46 adjacent the transverse arm 44, moving the flat spring 36 in the direction indicated by the arrow 56 to the position indicated in broken line in FIG. 4. This moves the catch 40 outwardly from its position in the opening 42, releasing the spare magazine 14 from its position within the carrier 10 substantially simultaneously with release of the magazine 16 from the receiver 18.

To use the carrier 10 of the present invention most advantageously, a rifleman will grasp the spare magazine 14 in his left hand while pushing the push button 52 leftward with his right hand. This allows the empty magazine 16 to be dropped from the receiver 18 and releases the spare magazine 14 into the rifleman's left hand, so that he may immediately insert the spare magazine 14 upwardly into position in the receiver 18. Releasing the push button 52 once the spare magazine 14 has been disengaged from the carrier 10 enables the magazine release mechanism of the automatic rifle 12 to engage and retain the spare magazine 14 once it has been inserted into position in the receiver 18. As a result the automatic rifle 12 may be extremely quickly reloaded once the magazine 16 has been emptied. Another loaded spare magazine 14 may be inserted into the carrier 10 at the first convenient opportunity.

Figure 6:
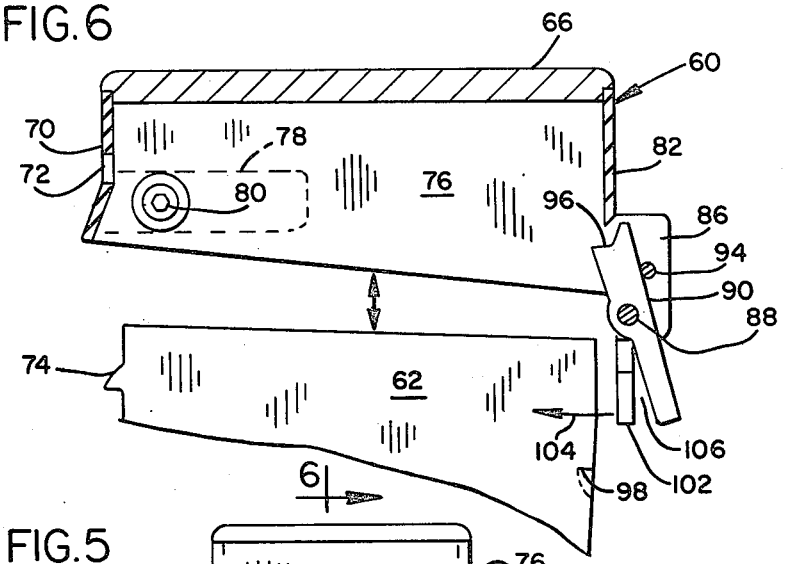
FIG. 6 is a sectional view of the spare magazine carrier shown in FIG. 5, taken along line 6—6.
Figure 5:
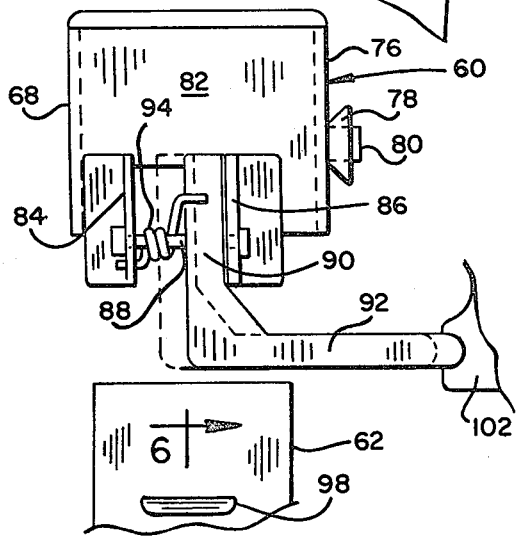
FIG. 5 is a rear elevational view of a spare magazine carrier which is an alternative embodiment of the present invention.
Figure 7:
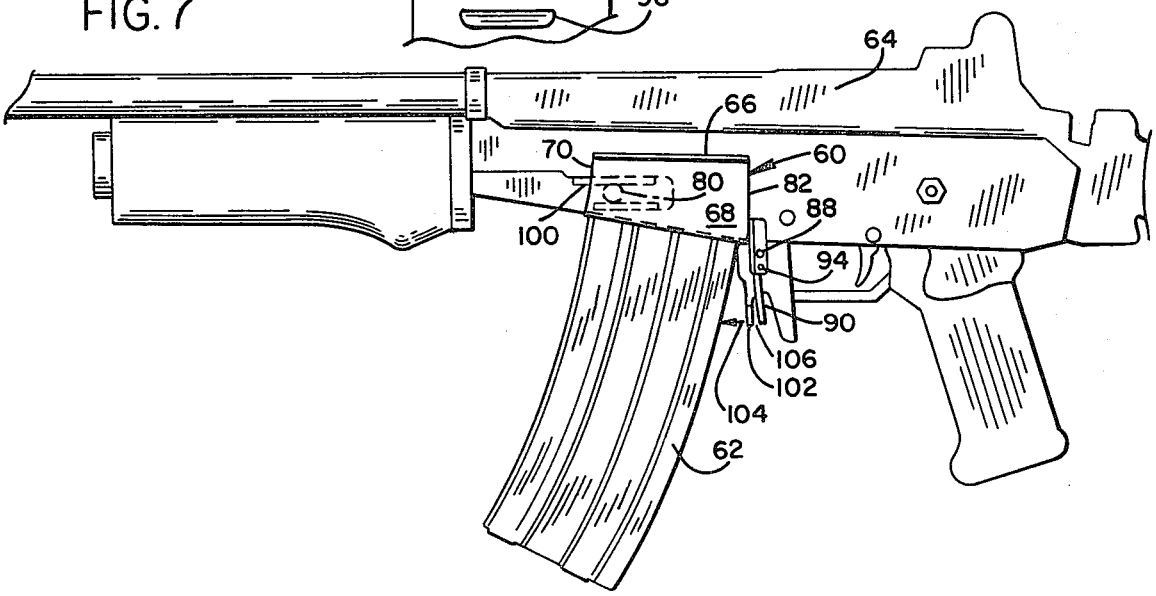
FIG. 7 is a side elevational view of the spare magazine carrier shown in FIG. 6, showing the spare magazine carrier installed on an automatic rifle.

Referring now to FIGS. 5–7, a spare magazine carrier 60 which is an alternative embodiment of the present invention may be used to hold a spare magazine 62 in a position of readiness attached to an automatic rifle 64 to permit immediate reloading of the automatic rifle 64 in a manner similar to that used with the automatic rifle 12 equipped with the spare magazine carrier 10. The spare magazine carrier 60 includes a body portion having a top member 66, a left side 68, and a short, downwardly extending front side 70 defining a hole 72 for receiving a detent 74 located on the front of the magazine 62. A right side 76 has attached thereto a dovetail plate 78. A retainer pin 80 which may, for example, be a short screw extends through the dovetail plate 78. On a rear side 82 completing a generally rectangular box-like protective covering for the spare magazine 62, a pair of brackets 84 and 86 extend rearwardly and downwardly. A pivot shaft 88 extends between the brackets 84 and 86.

A latch release lever 90 is pivotably and axially movable with respect to the pivot shaft 88, and includes a transverse arm 92 which extends rightward, toward the rifle 64. A spring 94 is biased to provide both a torsional and an axial force between the left bracket 84 and the latch release lever 90, to urge the latch release lever rightward and also urge it pivotally counterclockwise (as seen in FIG. 6) toward a position causing a catch 96 located on the latch release lever 90 to engage a recess 98 in the rear side of the spare magazine 62.

The spare magazine carrier 60 is mounted on the left side of the automatic rifle 64 by sliding the dovetail plate 78 into a dovetail groove 100 appropriately located on the side of the receiver portion of the rifle 64. The latch release lever 90 should be moved leftward along the pivot shaft 88, compressing the spring 94 axially as the spare magazine carrier 60 is slid rearwardly in the dovetail groove 100, to permit the transverse arm 92 to pass to the rearward side of a magazine release lever 102 of the rifle 64. Once the spare magazine carrier 60 is in the appropriate position the retainer screw 80 may be tightened to hold the carrier 60 in the appropriate location.

In some automatic rifles the dovetail slot 100 may be present as the location for a telescope mount, as in the case of a rifle such as the Galil automatic weapon used by the armed forces of Israel. In automatic rifles of this type a magazine release lever 102 may be pushed forward as indicated by the arrow 104 to release a magazine from engagement in the rifle itself. When the spare magazine carrier 60 is properly located on such a weapon a small amount of space 106 is provided between the transverse arm 92 of the latch release lever 90 and the magazine release lever 102, permitting a spare magazine 62 to be inserted into or removed from the spare magazine carrier 60 without releasing a magazine from the automatic rifle 64. Nevertheless, pushing forward far enough on the latch release lever 90 with the left thumb, preferably while grasping the spare magazine 62 with the left hand, causes the transverse arm 92 to push forward against the magazine release lever 102, simultaneously releasing the spare magazine 62 from the spare magazine carrier 60 and releasing an empty magazine from the automatic rifle 64. The spare magazine 62 can then be inserted immediately into the rifle 64 itself. Use of the spare magazine carrier 60 is thus essentially similar to use of the spare magazine carrier 10 as explained previously.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A spare magazine carrier for use with a firearm, comprising:

(a) protective means for covering an open end of a spare magazine for a firearm;

(b) attachment means for mounting said protective means on said firearm;

(c) latch means associated with said protective means for releasably holding a loaded spare magazine in a location in said spare magazine carrier in which said protective means covers an open end of said loaded spare magazine;

(d) latch release means associated with said latch means, for releasing said loaded spare magazine from said latch means substantially simultaneously with release of a magazine from operative engagement with said firearm, said latch release means including a pivot shaft and a latch release lever including a catch located thereon, said latch release lever being pivotably mounted on and axially reciprocally movable along said pivot shaft;

(e) a transverse arm extending from said latch release lever toward a magazine release mechanism of said firearm when said carrier is operatively mounted on said firearm; and (f) biasing means for urging said latch release lever toward a position of rotation about said pivot shaft enabling said catch to hold a loaded spare magazine in said spare magazine carrier and for urging said latch release lever axially along said pivot shaft toward a position of operative engagement of said transverse arm with said magazine release mechanism of said firearm.

2. The spare magazine carrier of claim 1, wherein said transverse arm extends to a position of engagement with said magazine release mechanism and wherein operation of said latch release means operates said magazine release mechanism to release a loaded spare magazine from said spare magazine carrier and a separate magazine from operative engagement in said firearm substantially simultaneously.

3. A spare magazine carrier for use with a firearm having a receiver for removably receiving a magazine in a position of operative engagement in said firearm in which the magazine extends downwardly from the receiver, said spare magazine carrier comprising:

(a) latch means for releasably engaging a loaded spare magazine; and (b) attachment means for holding said latch means in such a position relative to said receiver that a loaded spare magazine, when engaged by said latch means, extends downwardly therefrom and is located alongside, generally parallel with, and at substantially the same position with respect to the length of said firearm as a magazine located in said position of operative engagement in said firearm.

4. The spare magazine carrier of claim 3, including protective body means for protectively covering an open end portion of a loaded spare magazine engaged by said latch means.

5. The spare magazine carrier of claim 3, wherein said firearm includes a magazine release mechanism and said spare magazine carrier includes latch release means responsive to operation of said magazine release mechanism, for selectively releasing said loaded spare magazine from said spare magazine carrier substantially simultaneously with and in response to releasing a magazine from said position of operative engagement in said firearm.

6. The spare magazine carrier of claim 3, wherein said firearm includes a magazine release mechanism and said spare magazine carrier includes latch release means for releasing a loaded spare magazine from said spare magazine carrier, said latch release means including means for selectively operating said magazine release mechanism to release a magazine from said position of operative engagement in said firearm in response to and substantially simultaneously with releasing said loaded spare magazine from said spare magazine carrier.

7. The spare magazine carrier on claim 3, including a boxlike body having a top and a plurality of sides adapted to cover an open end of a loaded spare magazine, said latch means being associated with at least one of said sides.

8. The spare magazine carrier of claim 3, wherein said attachment means includes a strap and means for tightening said strap around a portion of said receiver of said firearm to fasten said spare magazine carrier thereto.

9. The spare magazine carrier of claim 3, wherein said attachment means includes a dovetail member adapted to engage a dovetail groove included in said firearm, and locking means for retaining said dovetail member in engagement with said dovetail groove.

10. In combination with a firearm including a receiver for receiving a magazine in a position of operative engagement therein, said receiver having a side, a spare magazine carrier for carrying a loaded spare magazine for said firearm, separate from and in addition to any magazine already in a position of operative engagement in said firearm, said spare magazine carrier comprising:

(a) protective means for covering an open end of a loaded spare magazine for a firearm;

(b) attachment means for mounting said protective means on said firearm in a position adjacent said side of said receiver of said firearm; and (c) latch means associated with said protective means, for releasably holding a loaded spare magazine in a location in which said protective means covers an open end of said loaded spare magazine, with said loaded spare magazine located alongside and at substantially the same position relative to the length of said firearm as any magazine already in said position of operative engagement in said firearm.

11. The spare magazine carrier of claim 10, including latch release means for selectively releasing said loaded spare magazine in response to releasing a magazine from said position of operative engagement in said firearm.

12. The spare magazine carrier of claim 10, wherein said firearm includes a magazine release mechanism for releasing a magazine from said position of operative engagement therein, said spare magazine carrier further including latch release means for releasing said spare magazine from said latch means and means for selectively operating said magazine release mechanism in response to operation of said latch release means.

13. The spare magazine carrier of claim 10, wherein said protective means comprises a box-like body having a top and a plurality of sides, said body being adapted to cover an open end of a spare magazine, and said latch means being associated with at least one of said sides of said body.

14. The spare magazine carrier of claim 10, wherein said attachment means includes a strap and means for tightening said strap around a portion of said receiver of said firearm to fasten said spare magazine carrier thereto.

15. The spare magazine carrier of claim 10, wherein said firearm includes a dovetail groove and said attachment means includes a dovetail member adapted to engage said dovetail groove and locking means for retaining said dovetail member in engagement with said dovetail groove.

* * * * *